US006200055B1

(12) United States Patent
Fusaro, Jr.

(10) Patent No.: US 6,200,055 B1
(45) Date of Patent: Mar. 13, 2001

(54) DISPENSER DEVICE FOR DISPENSING METERED DOSES OF VISCOUS MATERIAL

(75) Inventor: Louis J. Fusaro, Jr., Chester, NJ (US)

(73) Assignee: Stephen Gould Corporation, Whippany, NJ (US)

( * ) Notice: Subject to any disclaimer, the term of this patent is extended or adjusted under 35 U.S.C. 154(b) by 0 days.

(21) Appl. No.: 09/336,316

(22) Filed: Jun. 18, 1999

(51) Int. Cl.[7] ..... B43K 5/10

(52) U.S. Cl. ..... 401/178; 401/151; 401/171; 401/176; 417/460

(58) Field of Search ..... 401/263, 151, 401/170, 171, 176, 178, 179, 180, 181; 417/460, 466

(56) References Cited

U.S. PATENT DOCUMENTS

| | | | | |
|---|---|---|---|---|
| 3,144,676 | * | 8/1964 | LaMura | 401/151 |
| 3,227,165 | * | 1/1966 | Costanza | 401/178 |
| 4,033,700 | | 7/1977 | Spatz | 401/180 |
| 4,597,683 | | 7/1986 | Wittersheim et al. | 401/4 |
| 4,624,594 | | 11/1986 | Sasaki et al. | 401/176 |
| 4,685,819 | * | 8/1987 | Endo | 401/151 |
| 4,710,178 | | 12/1987 | Leonard et al. | 604/209 |
| 4,836,704 | | 6/1989 | Roeder | 401/146 |
| 4,892,427 | | 1/1990 | Ford | 401/182 |
| 4,991,749 | | 2/1991 | Kay et al. | 222/384 |
| 5,007,755 | | 4/1991 | Thompson | 401/175 |
| 5,035,524 | * | 7/1991 | Sakurai | 401/151 |
| 5,123,766 | | 6/1992 | Babiak | 401/180 |
| 5,674,204 | | 10/1997 | Chanoch | 604/211 |

* cited by examiner

*Primary Examiner*—David J. Walczak
(74) *Attorney, Agent, or Firm*—Arthur L. Plevy; Buchanan Ingersoll PC

(57) ABSTRACT

A dispensing device including a pump assembly for pumping out the viscous liquid material stored in the device. The pump has a cylinder and a piston disposed within the cylinder, wherein the cylinder includes a cylinder inlet valve and the piston includes a cylinder outlet valve. Each operation of the pump assembly causes the piston to move in a first direction toward the cylinder inlet valve and in a second direction away from the cylinder inlet valve. The movement of the piston in the first direction causes the cylinder inlet valve to close and the cylinder outlet valve to open. The movement of the piston in the second direction causes the cylinder inlet valve to open and the cylinder outlet valve to close. When the pump assembly is primed with viscous liquid material, movement of the piston in the first direction pumps a predetermined volume of the viscous liquid material from the cylinder through the opened cylinder outlet valve, thereby causing a substantially corresponding predetermined volume of the viscous liquid material to be dispensed by the device. Movement of the piston in the second direction draws a substantially corresponding predetermined volume of the viscous liquid material from the device into the cylinder through the opened inlet valve thereby refilling the cylinder with the viscous material.

21 Claims, 7 Drawing Sheets

DISPENSER DEVICE FOR DISPENSING METERED DOSES OF VISCOUS MATERIAL

FIELD OF THE INVENTION

This invention relates to manually operated dispenser devices, and in particular, to a manually operated dispenser device for metering doses of viscous materials such as nail polish, lipstick, foundation, makeup and the like.

BACKGROUND OF THE INVENTION

There are many known dispenser devices for dispensing viscous material. Such devices have been employed in a variety of applications for discharging many different types of viscous materials. A common application for dispensers of this kind is in the field of cosmetic applicators. Typical cosmetic applicators are pen-like in design and dispense a cosmetic fluid onto an integrally disposed applicator when actuated by the user.

Pen-like fluid dispensing devices for manual user operation, especially those devices used for dispensing cosmetic fluids, must be capable of being fabricated inexpensively from readily available materials. In addition to the importance of minimizing manufacturing costs, it is equally important that such devices be fabricated to close tolerances in order to ensure proper fit and cooperative interengagement between both fixed and relatively movable parts, and to provide for reliable operation of the dispenser throughout its intended useful life which is usually until the initial supply of stored fluid is exhausted. In the case of cosmetic fluid dispensers, assuring continued operative reliability is much more difficult. This is because cosmetic fluids such as nail enamels, are relatively caustic to many common construction materials and quickly thicken and harden in the absence of adequate fluid tight seals, makes continued operative reliability much more difficult.

Typical known and commercially available dispenser devices commonly employ relatively complex mechanical designs which use large numbers of mutually engaging parts that must all cooperatively interact in order for the device to operate. Dispenser devices of this type are usually difficult and expensive to manufacture and often exhibit high failure rates as the devices approach the end or latter portion of their intended, useful lives. Moreover, many of these devices are difficult to operate.

Accordingly, there is a need for a dispenser device for dispensing metered doses of viscous material with enhanced reliability and ease of operation.

SUMMARY OF THE INVENTION

A dispensing device comprising a pump assembly for pumping out the viscous liquid material stored in the device. The pump includes a cylinder and a piston disposed within the cylinder, wherein the cylinder has a cylinder inlet valve and the piston has a cylinder outlet valve. Each operation of the pump assembly causes the piston to move in a first direction toward the cylinder inlet valve and in a second direction away from the cylinder inlet valve. The movement of the piston in the first direction causes the cylinder inlet valve to close and the cylinder outlet valve to open. The movement of the piston in the second direction causes the cylinder inlet valve to open and the cylinder outlet valve to close. When the pump assembly is primed with viscous liquid material, movement of the piston in the first direction pumps a predetermined volume of the viscous liquid material from the cylinder through the opened cylinder outlet valve, thereby causing a substantially corresponding predetermined volume of the viscous liquid material to be dispensed by the device. Movement of the piston in the second direction draws a substantially corresponding predetermined volume of the viscous liquid material from the device into the cylinder through the opened inlet valve thereby refilling the cylinder with the viscous material.

BRIEF DESCRIPTION OF THE DRAWINGS

The advantages, nature and various additional features of the invention will appear more fully upon consideration of the illustrative embodiments now to be described in detail in connection with accompanying drawings wherein.

It should be understood that these drawings are for purposes of illustrating the concepts of the invention and are not to scale.

DETAILED DESCRIPTION OF THE INVENTION

Figure 1:
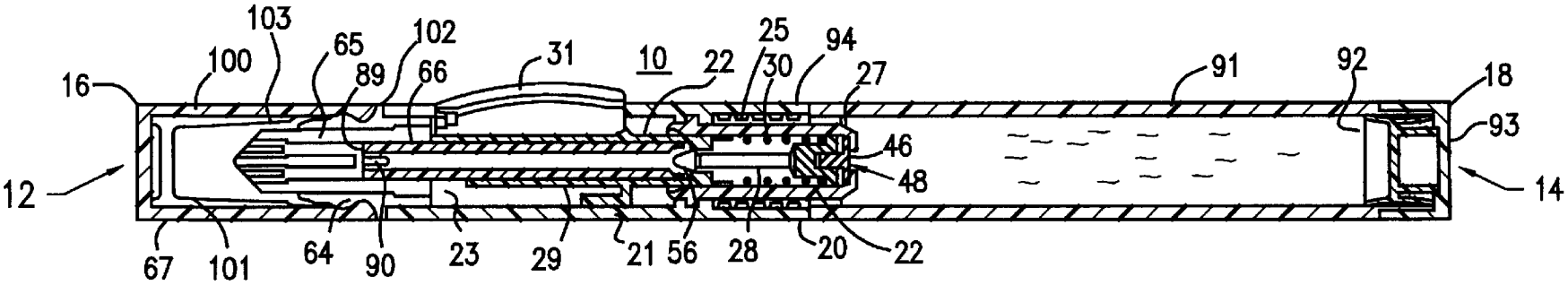
FIG. 1 is a sectional view of a device for dispensing metered doses of viscous material according to an embodiment of the invention.

FIG. 1 shows a sectional view of a device 10 for dispensing metered doses of viscous material according to an embodiment of the invention. The device 10 generally comprises an applicator assembly 16 disposed at a forward end 12 thereof, a reservoir assembly 18 disposed at a rearward end thereof 14, and a pump assembly 20 disposed between the applicator assembly 16 and the reservoir assembly 18. The device 10 is typically pen-like in design, however, other embodiments of the device can be configured to be shorter and wider if desired.

Figure 2A:
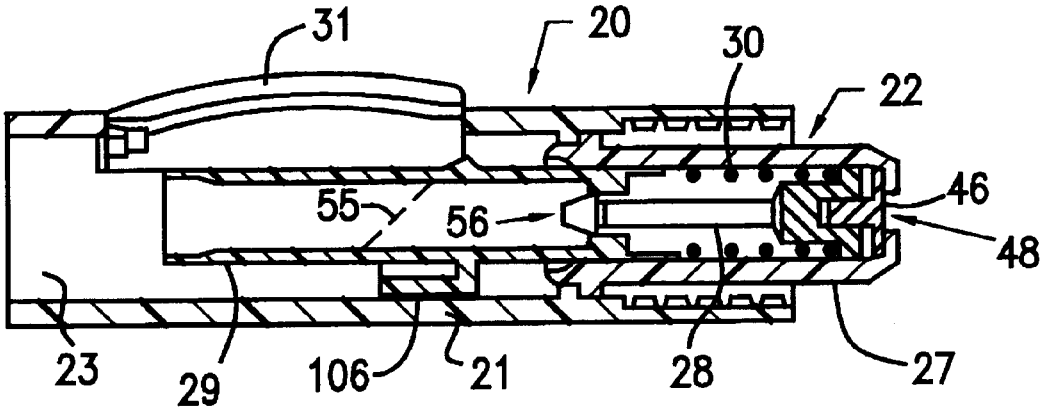
FIG. 2A is a sectional view of the pump assembly of the device of FIG. 1.
Figure 2B:
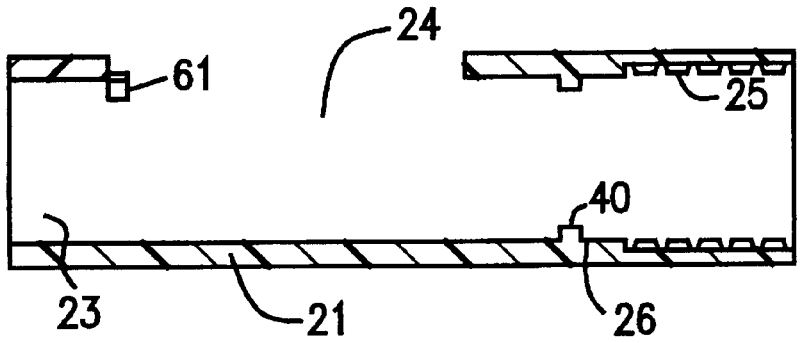
FIG. 2B is a detailed sectional view the pump housing of the pump assembly.

FIG. 2A shows a sectional view of the pump assembly 20 of the device 10. The pump assembly 20 includes an opened ended, elongated cylindrical pump housing 21 which contains a dispensing pump 22. As shown in the sectional view of FIG. 2B, the pump housing 21 has an axial bore 23 and a side wall aperture 24 that opens into the bore 23. A button hinge flange 61 is provided just below the forward end of the pump housing aperture 24. The forward end of the pump housing 21 is conventionally adapted for retaining the applicator assembly 16 therein and the rearward end of the pump housing 21 includes an internal screw thread 25 for threadedly connecting the reservoir assembly 18. The inner surface of the pump housing 21 includes an annular locating groove 26 and a flange 40 both formed adjacent the forward end of the thread 25.

Referring again to FIG. 2A, the dispensing pump 22 generally comprises a cylinder 27, a needle sealing element 28 mounted in the cylinder 27, a pump piston 29 reciprocally disposed in the cylinder 27, a biasing element 30 positioned in the cylinder 27 between the pump piston 29 and the needle sealing element 28, a flexible circular diaphragm member 46 disposed between the sealing element 28 and the cylinder 27 and a button 31 for finger operation of the pump 22.

Figure 3:
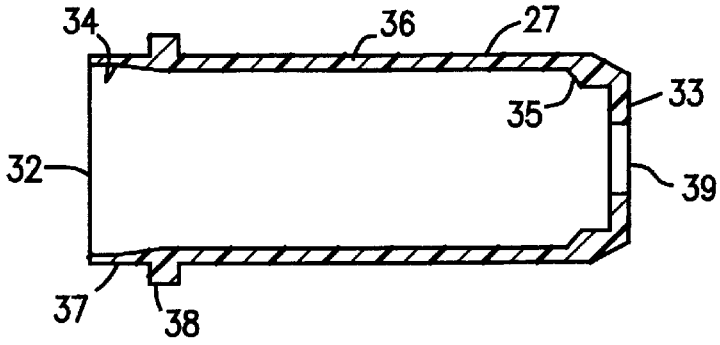
FIG. 3 is a detailed sectional view of the cylinder of the dispensing pump.

FIG. 3 shows a detailed sectional view of the cylinder 27 of the dispensing pump 22. The cylinder 27 has an open forward end 32 and a closed rearward end 33. The inner surface 34 of the cylinder 27 at its forward end 32 tapers outwardly to allow insertion of the pump piston 29 during assembly of the pump 22. The closed rearward end 33 of the cylinder 27 includes a centrally located inlet orifice 39. The inner surface 34 of the cylinder 27 adjacent the closed end 33 thereof includes an annular seating flange 35 for mounting the needle sealing element 28. The outer surface 36 of the cylinder 27 adjacent the forward open end 32 thereof, has an annular locking bead 37 and a flange 38 which together coact with the pump housing's interior locating groove 26 and flange 40 arrangement to mount the cylinder 27 within the axial bore 23 of the pump housing 21. When mounted, the rearward end 33 of the cylinder 27 extends beyond the rearward end of the pump housing 21 into the reservoir assembly 18 as shown in FIG. 1.

Figure 4A:
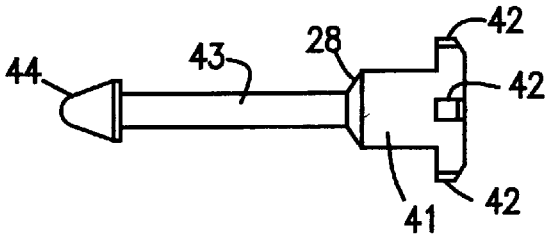
FIGS. 4A and 4B are detailed elevational views of the needle sealing element of the dispensing pump.
Figure 4B:
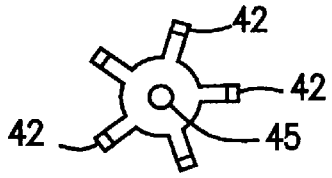

FIGS. 4A and 4B show detailed elevational views of the needle sealing element of the dispensing pump 22. The needle sealing element 28 includes a base 41 with a plurality of radially extending spokes 42 disposed at the rearward end of the base 41 and a shaft 43 extending from the forward end of the base 41. The spokes 42 of the needle sealing element 28 rest on the seating flange 35 of the cylinder 27 when the element 28 and the cylinder 27 are assembled. The rearward end of the base 41 further includes a centrally located aperture 45. The forward end of the shaft 43 includes an enlarged, forwardly tapered sealing member 44.

Figure 5A:
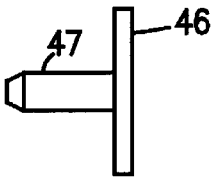
FIGS. 5A and 5B are detailed elevational views of the diaphragm member of the dispensing pump.
Figure 5B:
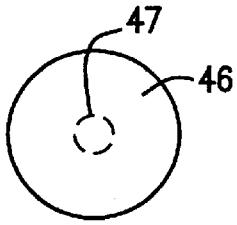

FIGS. 5A and 5B show detailed elevational views of the diaphragm member 46 of the dispensing pump 22. The diaphragm member 46 includes a unitarily formed centrally located mounting post 47 which is slidably received in the aperture 45 of the needle sealing element base 41. The mounting post 47 aligns the diaphragm member 46 with the cylinder inlet orifice 39 thus, forming a cylinder inlet valve 48 (FIG. 2A) as will be explained further on.

Figure 7A:
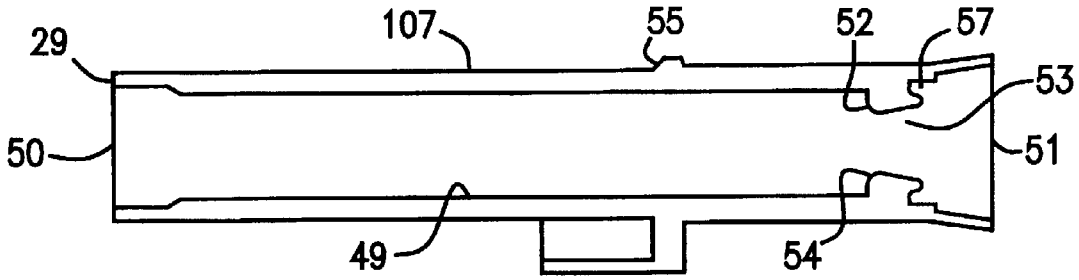
FIG. 7A is a detailed sectional view of the pump piston of the dispensing pump.
Figure 7B:
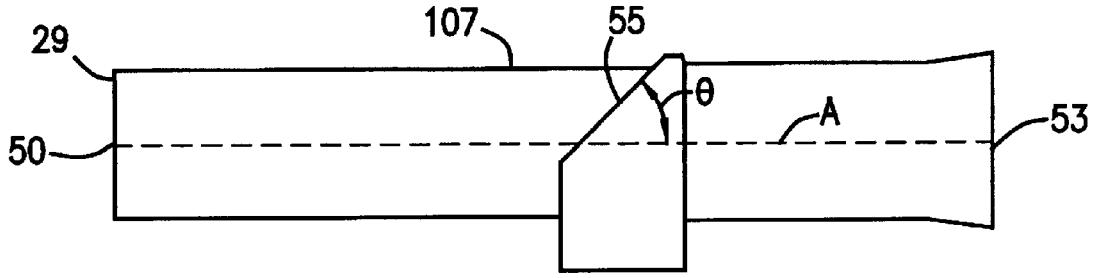
FIGS. 7B and 7C are detailed elevational views of the pump piston of the dispensing pump.
Figure 7C:
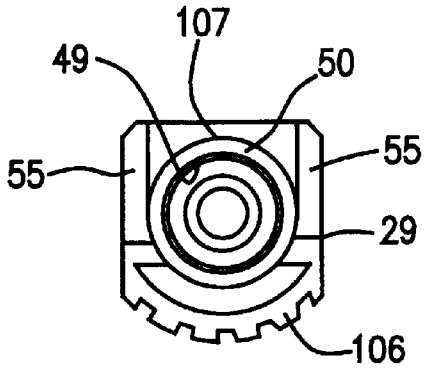

The pump piston 29 of the dispensing pump 22 is shown in detail in the sectional view of FIG. 7A and the elevational views of FIGS. 7B and 7C. The pump piston 29 comprises an elongated tubular member having an outer surface 107, an inner surface 49, an open forward end 50 and an outwardly flared rearward end 51. The inner surface 49 of the pump piston 29 adjacent the rearward end 51 thereof is occluded by a partition member 52. The partition member 52 includes an outlet orifice 53 with an annular beveled sealing surface 54 on its forward side and an annular recess 57 on its rearward side. The outer surface 107 of the pump piston 29 includes a pair of cam surfaces 55 which are formed on opposite sides thereof. The cam surfaces 55 are disposed at an angle θ measured from the longitudinal axis A of the pump piston 29, this angle θ typically measuring between about 40 and 50 degrees. The cam surfaces 55 coact with the button 31 positioned within the aperture 24 of the pump housing 21 as will be explained further on in greater detail. The cam surfaces 55 are connected by an arcuate support member 106 that engages the inner surface of the pump housing 21 (FIG. 2A) to prevent bending of the pump piston 29 when actuated by the button 31.

As shown in FIG. 2A, the rearward end 51 of the piston 29 fits into the open end 32 of the cylinder 27, such that the rearward end 51 of the piston 29 sealingly engages the inner surface of the cylinder 27. Further, the sealing member 44 of the needle sealing element 28 extends through the outlet orifice 53 of the piston 29 thereby defining a cylinder outlet valve 56.

Figure 6A:
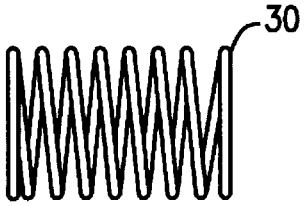
FIGS. 6A and 6B are detailed elevational views of the biasing element of the dispensing pump.
Figure 6B:
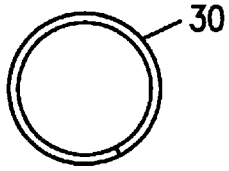

FIGS. 6A and 6B show detailed elevational views of the biasing element 30 of the dispensing pump 22. The biasing element 30 typically comprises a conventional hectically wound coil metal or plastic spring. As shown in FIG. 2A, the biasing element 30 is disposed in the cylinder 27 such that the forward end of the spring is seated in the recess 57 defined in the partition member 52 of the pump piston 29 and the rearward end of the spring is seated on the spokes 42 of the needle sealing element 28. Thus, in a non-dispensing mode (FIG. 1), the biasing element 30 biases the beveled sealing surface 54 of the pump piston outlet orifice 53 against the sealing member 44 of the needle sealing element 28 thereby closing the cylinder outlet valve 56 (FIG. 2A).

Figure 8A:
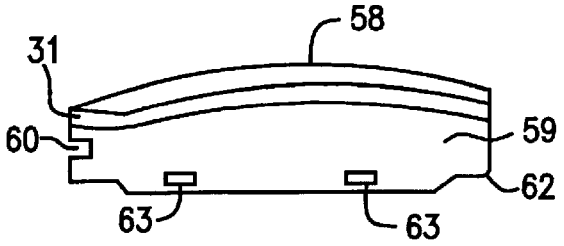
FIGS. 8A and 8B are detailed elevational views of the button of the dispensing pump.
Figure 8B:
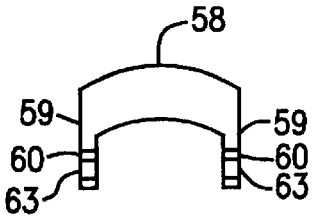

FIGS. 8A and 8B show detailed elevational views of the button 31 of the dispensing pump 22. The button 31 has a upside-down U-shaped cross-section formed by a generally convex top wall 58 and a pair of parallel spaced side walls 59. Slots 60 are formed in the forward edges of the side walls 59. The slots 60 permit the button 31 to pivot on the hinge flange 61 of the pump housing aperture 24 while the rearward corners 62 of the button side walls 59 slidingly engage the cam surfaces 55 of the pump piston 29. A pair of elongated projections 63 are provided on the outer surface of each button side wall 59. The projections 63 engage the inner surface of the pump housing 21 to prevent the button 31 from being separated from the pump housing 21.

Referring again to FIG. 1, the applicator assembly 16 includes an applicator holder 64, an applicator member 65 disposed in the holder 64, a transfer tube 66 inserted in the applicator member 65, a second flexible circular diaphragm member 89 disposed between the transfer tube 66 and applicator member 65 and a removable closure 67 for sealingly covering the applicator member 68.

Figure 9A:
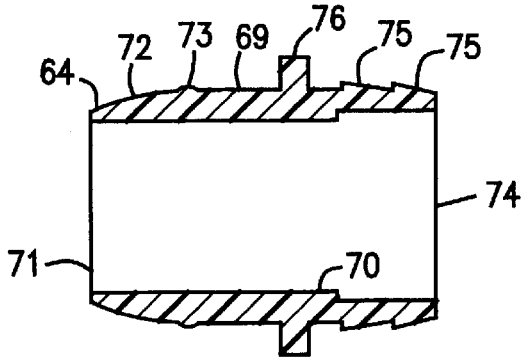
FIG. 9A is a detailed sectional view of the applicator holder of the applicator assembly.
Figure 9B:
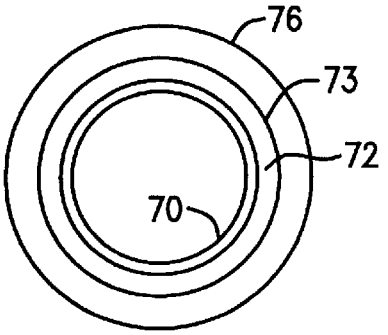
FIG. 9B is a detailed elevational view of the applicator holder of the applicator assembly.

The applicator holder 64 of the applicator assembly 16 is shown in detail in the sectional view of FIG. 9A and the elevational view of 9B. The applicator holder 64 has a generally cylindrical an outer surface 69 and a stepped cylindrical inner surface 70. The outer surface 69 tapers at 72 toward the inner surface 70 at the forward end 71 of the holder 64. An annular bead 73 for snap-engaging the closure 67 to the applicator assembly 16, is provided on the outer surface 69 adjacent the tapered outer sealing surface 72. The outer surface 69 includes two annular barb projections 75 at the rearward end 74 of the holder, for fixing the applicator assembly 16 in the forward end of the pump housing axial bore 23. A circumferential flange 76 on the outer surface 69 of the holder 64 abuts against the edge of the pump housing 21 to prevent the holder 64 from being pushed into the housing 21 during use.

Figure 10A:
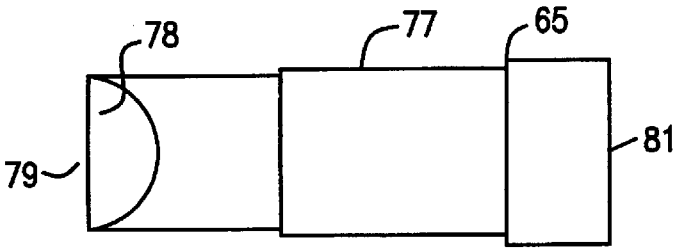
FIGS. 10A and 10B are detailed elevational views of the applicator member of the applicator assembly.
Figure 10B:
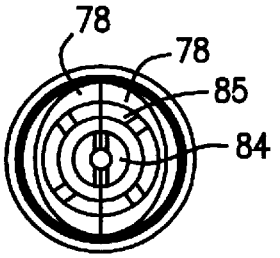
Figure 10C:
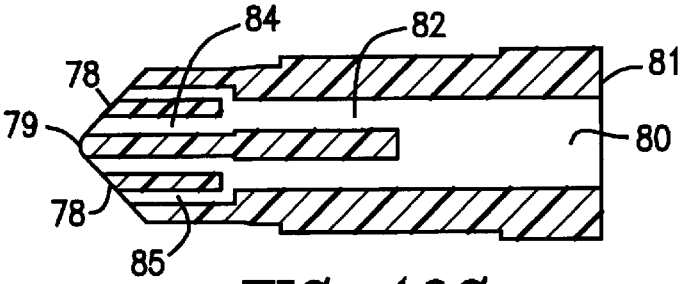
FIG. 10C is a detailed sectional view of the applicator member of the applicator assembly.

The applicator member 65 of the applicator assembly 16 is shown in detail in the elevational views of FIGS. 10A and 10B, and the sectional view of FIG. 10C. The applicator member 65 has a generally cylindrical stepped outer surface 77. The outer surface 77 defines a pair of converging beveled surfaces 78 at the forward end 79 of the member 65 which function as dispensing contact surfaces. The applicator member 65 includes an interior bore 80 that extends forwardly from the rearward end 81 thereof to an annular channel 82 which then branches off into a pair of smaller, concentrically arranged inner and outer annular channels 84, 85 that communicate with the beveled surfaces 78. In other embodiments of the device, the applicator member can be conventionally configured as a brush, a ball carrying member, one or more dispensing ports and the like.

Figure 11:
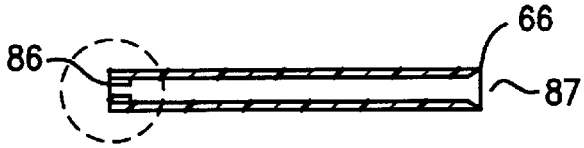
FIGS. 11, 11B, and 11C are detailed sectional views of the transfer tube of the applicator assembly.
Figure 11B:
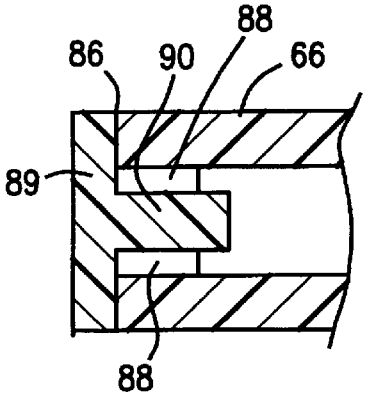
Figure 11C:
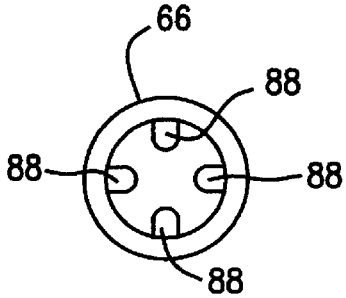

The details of the transfer tube 66 of the applicator assembly 16 are shown in the sectional views of FIGS. 11A, 11B, and 11C. The transfer tube 66 has a forward open end 86 and a rearward open end 87. Four equally-spaced lugs 88 are formed on the interior at the forward end 86 of the tube 66. The lugs 88 secure the second diaphragm member 89 (shown in detail in FIG. 11B) to the transfer tube 66 by the member's 89 mounting post 90.

As shown in FIG. 1, the forward open end 86 of the transfer tube 66 is fixedly disposed in the bore 80 at the rearward end of the applicator member 65 and the rearward open end 87 extends into the forward open end 50 of the pump piston 29. The second flexible circular diaphragm member 89 selectively opens and closes the forward open end 86 of the transfer tube 66 as will be explained further on.

Referring still to FIG. 1, the removable closure 67 of the applicator assembly 16 includes an outer cap member 100 and an inner cap member 101. The outer cap member 100 includes annular inner bead 102 which cooperates with the annular outer bead 73 of the applicator holder 64 to snap lock of the closure 67 to the applicator assembly 16. The inner cap member 101 includes a sealing surface 103 which engages the tapered sealing surface 72 of the applicator holder 64 to prevent leakage of viscous material from the applicator assembly 16.

Referring still again to FIG. 1, the reservoir assembly 18 includes an elongated, open-ended cylindrical reservoir member 91, a passive piston 92 disposed in the rearward end of the reservoir member 91, and an end cap 93 fixed in the rearward end of the reservoir member 91. The forward end of the reservoir includes an external thread 94 which threadedly engages the internal thread 25 at the rearward end of the pump housing 21 to attach the reservoir assembly 18 thereto. In other embodiments of the invention, the reservoir assembly 18 and the pump housing 21 can be a single unitary member.

Figure 12A:
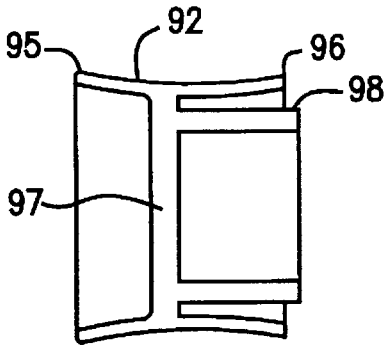
FIG. 12A is a detailed sectional view of the passive piston of the reservoir assembly.
Figure 12B:
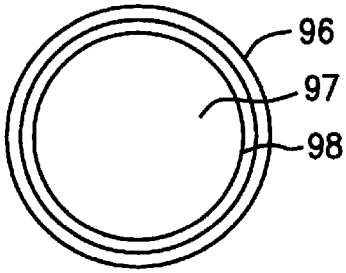
FIG. 12B is a detailed elevational view of the passive piston of the reservoir assembly.

The details of the passive piston 92 of the reservoir assembly 18 is shown in the sectional view of FIG. 12A and the elevational view of 12B. The passive piston 92 includes an outwardly flared cup-like forward end 95 and an outwardly flared cup-like rearward end 96 which both share a common base wall 97. A cylindrical projection 98 extends rearwardly from within the base wall 97.

The operation of the device 10 will now be described with reference to FIGS. 13A and 13B. The operational description assumes that the device has been primed, i.e., viscous material 105 to be dispensed has been drawn into the cylinder 27, the transfer tube 66, and the applicator member 65 from the reservoir assembly 18.

Figure 13A:
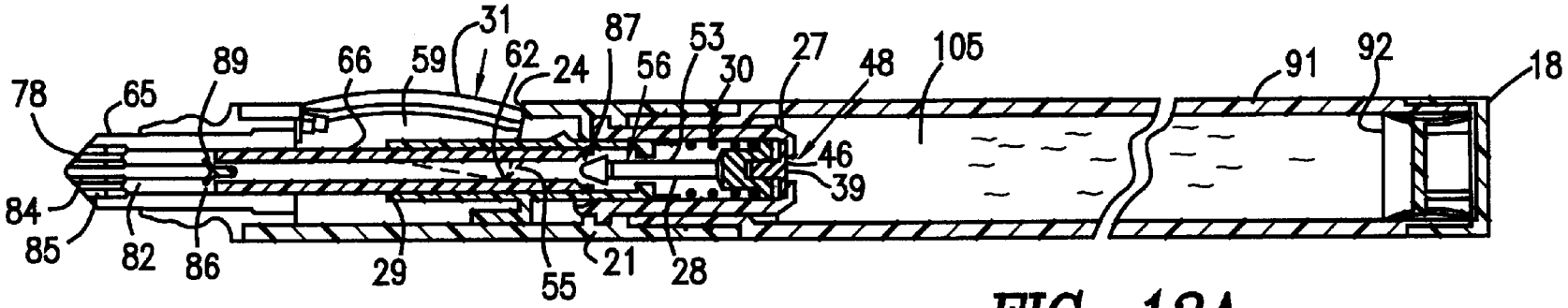
FIGS. 13A and 13B are sectional views of the device depicting its operation.
Figure 13B:
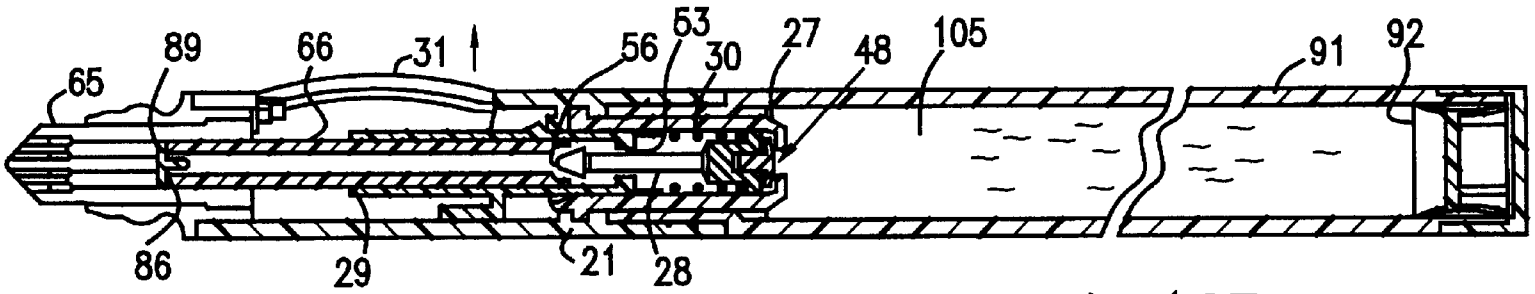

As shown in FIG. 13A, dispensing commences when the button 31 of the dispensing pump 22 is pressed. As the button 31 pivots through the aperture 24, the rearward corners 62 of the button sidewalls 59 slidably engage the cam surfaces 55 (shown with broken lines) of the pump piston 29, causing it to move rearwardly further into the cylinder 27, thereby compressing the biasing element 30. The cylinder volume reduction caused by the pump piston's 29 rearward movement into the cylinder produces a positive pressure in the cylinder 27 which closes the cylinder inlet valve 48 formed by the diaphragm member 46 and the cylinder inlet orifice 39. The rearward movement of the pump piston 29 also opens the cylinder outlet valve 56 formed by the needle sealing element 28 and the pump piston outlet orifice 53. These valving changes forces or meters a certain volume or dose of viscous material 105 contained in the cylinder 27 out the pump piston outlet orifice 53 into the rearward end 87 of the transfer tube 66. The metered volume of viscous material 105 is generally determined by the rearward stroke distance of the pump piston 29 and the area of the cylinder 27.

The flow of the metered volume of viscous material 105 causes the entire column of viscous material in the transfer tube 66 and applicator member 65 to flow forwardly. The viscous material flow in the transfer tube 66 opens the second diaphragm member 89 sealing the forward open end 86 of the transfer tube 66 thus, permitting a correspondingly similar volume of viscous material 105 to flow from the transfer tube 66 into the channels 82, 84, 85 of applicator member 65 and out onto the member's beveled outer surfaces 78.

When the pump piston 29 reaches the end of its rearward stroke, viscous material flow ceases and the second diaphragm member 89 automatically reseals the forward open end 86 of the transfer tube 66. When the button 31 is released as shown in FIG. 13B, the biasing force exerted by the biasing element 30 on the pump piston 29 forwardly moves the pump piston 29 to its original shallow position in the cylinder 27. This forward movement of the pump piston 29 creates a negative pressure or vacuum in the cylinder 27 which opens the cylinder inlet valve 48. Because rearward end of the cylinder 27 is immersed in the viscous material 105 stored in the reservoir member 91, the vacuum draws this viscous material 105 into the cylinder 27, thereby refilling it. As the viscous material 105 in the reservoir member 91 moves forwardly during refilling of the cylinder 27, it creates a vacuum which moves the passive piston 92 forwardly thus, keeping the rearward end of the cylinder 27 immersed in the viscous material 105.

While the foregoing invention has been described with reference to the above embodiments, various modifications and changes can be made without departing from the spirit of the invention. Accordingly, all such modifications and changes are considered to be within the scope of the appended claims.

What is claimed is:

1. A dispensing device comprising:

a pump assembly for pumping out the viscous liquid material stored in the device, the pump including a cylinder and a piston disposed within the cylinder, the cylinder having a cylinder inlet valve orifice and the piston having a cylinder outlet valve orifice, wherein each operation of the pump assembly causes the piston to move in a first direction toward the cylinder inlet valve orifice and in a second direction away from the cylinder inlet valve orifice, the movement of the piston in the first direction causing the cylinder inlet valve orifice to be closed and the cylinder outlet valve orifice to be opened, the movement of the piston in the second direction causing the cylinder inlet valve orifice to be opened and the cylinder outlet valve orifice to be closed;

wherein, when the pump assembly is primed with viscous liquid material, movement of the piston in the first direction pumps a predetermined volume of the viscous liquid material from the cylinder through the opened cylinder outlet valve orifice, thereby causing a substantially corresponding predetermined volume of the viscous liquid material to be dispensed by the device, and the movement of the piston in the second direction draws a substantially corresponding predetermined volume of the viscous liquid material from the device into the cylinder through the opened inlet valve orifice thereby refilling the cylinder with the viscous material.

2. The dispensing device according to claim 1, further comprising a reservoir assembly for storing a viscous liquid material, wherein a portion of the pump assembly becomes partially immersed in the viscous liquid material when the same is stored in the reservoir assembly.

3. The dispensing device according to claim 2, wherein the reservoir assembly includes a piston for keeping the portion of the pump assembly partially immersed in the viscous liquid material when the same is stored in the reservoir assembly.

4. The dispensing device according to claim 2, wherein the reservoir assembly includes an elongated cylindrical reservoir, the cylinder is disposed within an open end of the reservoir, the cylinder forming the portion of the pump assembly partially immersed in the viscous liquid material when the same is stored in the reservoir.

5. The dispensing device according to claim 4, wherein the pump assembly is disposed within a cylindrical housing that is coupled to the reservoir of the reservoir assembly.

6. The dispensing device according to claim 5, wherein the button is pivotally mounted to cylindrical housing.

7. The dispensing device according to claim 1, further comprising an applicator assembly for dispensing the viscous liquid material pumped by the pump assembly, the applicator assembly in communication with the cylinder outlet valve orifice of the piston.

8. The dispensing device according to claim 7, wherein the applicator assembly includes a closure.

9. The dispensing device according to claim 7, wherein the applicator assembly includes an applicator and a tube extending from the applicator toward the piston and engaged therewith, the tube for transferring viscous liquid material from the cylinder outlet valve orifice of the piston to an external dispensing surface of the applicator.

10. The dispensing device according to claim 9, wherein the tube includes an outlet valve orifice.

11. The dispensing device according to claim 10, wherein the outlet valve orifice is opened when the piston moves in the first direction and closed when the piston moves in the second direction.

12. The dispensing device according to claim 1, wherein the pump assembly further includes a finger operable button which coacts with the piston to cause the piston to move in the first and second directions.

13. The dispensing device according to claim 12, wherein the piston includes a cam surface which is slidably engaged by the button to cause the piston to move in the first and second directions.

14. The dispensing device according to claim 12, wherein the button is pivotally mounted to the pump assembly.

15. The dispensing device according to claim 14, wherein the piston includes a cam surface which is slidably engaged by a pivoting end of the button, such that as the pivoting end of the button slides along the cam surface in a first direction, the piston to moves in one of the first and second directions, and as the pivoting end of the button slides along the cam surface in a second direction, the piston to moves in the other one of the first and second directions.

16. The dispensing device according to claim 1, further comprising a biasing element disposed between the cylinder and the piston for biasing the piston in the second direction.

17. A dispensing device comprising:

a pump assembly for pumping out the viscous liquid material stored in the device, the pump including a cylinder and a piston disposed within the cylinder, the cylinder having a cylinder inlet valve orifice and the piston having a cylinder outlet valve orifice, wherein each operation of the pump assembly causes the piston to move in a first direction toward the cylinder inlet valve and in a second direction away from the cylinder inlet valve, the movement of the piston in the first direction causing the cylinder inlet valve orifice to close and the cylinder outlet valve orifice to open, the movement of the piston in the second direction causing the cylinder inlet valve orifice to open and the cylinder outlet valve orifice to close;

a reservoir assembly for storing a viscous liquid material, the pump assembly having a portion that becomes partially immersed in the viscous liquid material when the same is stored in the reservoir assembly; and an applicator assembly for dispensing the viscous liquid material pumped by the pump assembly, the applicator assembly in communication with the cylinder outlet valve orifice of the piston;

wherein, when the pump assembly is primed with viscous liquid material, movement of the piston in the first direction pumps a predetermined volume of the viscous liquid material from the cylinder through the opened cylinder outlet valve orifice, thereby causing a substantially corresponding predetermined volume of the viscous liquid material to be dispensed by the applicator assembly, and the movement of the piston in the second direction draws a substantially corresponding predetermined volume of the viscous liquid material from the reservoir assembly into the cylinder through the opened inlet valve orifice thereby refilling the cylinder with the viscous material.

18. The dispensing device according to claim 17, wherein the pump assembly further includes a finger operable button which coacts with the piston to cause the piston to move in the first and second directions.

19. The dispensing device according to claim 18, wherein the piston includes a cam surface which is slidably engaged by the button to cause the piston to move in the first and second directions.

20. The dispensing device according to claim 18, wherein the button is pivotally mounted to the pump assembly.

21. The dispensing device according to claim 20, wherein the piston includes a cam surface which is slidably engaged by a pivoting end of the button, such that as the pivoting end of the button slides along the cam surface in a first direction, the piston to moves in one of the first and second directions, and as the pivoting end of the button slides along the cam surface in a second direction, the piston to moves in the other one of the first and second directions.

* * * * *